United States Patent [19]

Fielden, Jr.

[11] Patent Number: 4,864,837

[45] Date of Patent: Sep. 12, 1989

[54] APPARATUS FOR PRODUCING PANEL ROOFING

[76] Inventor: Swan R. Fielden, Jr., 23 Brams Point Rd., Hilton Head, S.C. 29928

[21] Appl. No.: 250,590

[22] Filed: Sep. 29, 1988

[51] Int. Cl.[4] ..... B21D 5/08

[52] U.S. Cl. ..... 72/176; 72/181; 72/226; 52/749

[58] Field of Search ..... 72/181, 176, 180, 183, 72/131, 237, 226; 52/528, 540, 746, 749

[56] References Cited

U.S. PATENT DOCUMENTS

| | | | |
|---|---|---|---|
| 3,031,027 | 4/1962 | Mitchell | 182/63 |
| 3,245,192 | 4/1966 | Hilson | 52/746 |
| 3,791,185 | 2/1974 | Knudson | 72/181 |
| 4,020,666 | 5/1977 | Beymer | 72/181 |
| 4,078,355 | 3/1978 | Clemensen | 52/749 |
| 4,491,449 | 1/1985 | Hawkins | 414/10 |
| 4,546,852 | 10/1985 | Martin et al. | 182/12 |
| 4,660,399 | 4/1987 | Suter et al. | 72/181 |
| 4,785,606 | 11/1988 | Burton | 52/749 |

OTHER PUBLICATIONS

Vendor literature descriptive of a Knudson KR-18 panel manufacturing system sold by Redi-Built Products of Broomfield, Colo.

Vendor literature descriptive of a "Seam Panformer" sold by ESC Machines of Exton, Pa.

Vendor literature descriptive of a "Job Siter" rib panel producr sold by Jeanway Industries, Inc., of Springdale, Ark.

Vendor literature descriptive of a Knudson model P-2401 panel manufacturing machine.

*Primary Examiner*—Daniel C. Crane

*Attorney, Agent, or Firm*—Finnegan, Henderson, Farabow, Garrett & Dunner

[57] ABSTRACT

Apparatus for producing panel roofing includes a platform mounted on an elevating mechanism. A panel producing machine is mounted on a support stand which in turn rides on tracks along a length dimension of the platform. A decoiler for decoiling metal sheet stock fed into the machine also rides on tracks along the platform length. The machine is oriented to produce panels in a direction perpendicular to the platform length dimension. With the platform elevated to roof edge and its length dimension parallel to that edge, the panel producing machine and decoiler are moved along the platform following extrusion of each successive roofing panel. In a preferred embodiment, the machine can be pitched to match a pitch of the roof to facilitate panel production.

29 Claims, 4 Drawing Sheets

110
112
114
120
122
124
126
130
132
136
200
202
204
206
208
210
212
220
224
226
228
230
240
242
244
246
248
250
252
260
262
264
266
270
272
274
300
318
350
352
354
356
254

110
220
222
208
210

APPARATUS FOR PRODUCING PANEL ROOFING

BACKGROUND OF THE INVENTION

1. Field of the Invention

The present invention relates to apparatus for producing panel roofing material and, more particularly, apparatus comprising a panel producing machine that is mounted on and movable along an elevatable plateform that can be elevated to the edge of a roof on which panel roofing is to be installed.

2. Description of the Prior Art

Panel roofing, well known in the art, consists of successive metallic sheets of paneling layed side-by-side to form the roofing cover. Each roofing panel is formed by a panel producing machine from metal sheet stock, typically fed from a roll of sheet metal. The forming of each panel can include molding ribs down the panel length but, more importantly, includes forming both lengthwise edges of each panel into a form enabling a mating fit between the abutting lengthwise edges of adjacent panels. In some cases, in a subsequent operation, a seamer device is used to form the mating edges into a weather-tight seam down the entire panel length. As known in the art, clips are typically interleaved between the adjacent panel edges to affix the panels to the roof surface. A primary advantage of panel roofing is that the individual panels can be fabricated to any required length, i.e., the length of each panel can span the entire width of the roof area being covered. As a result, there need be no seams perpendicular to the lengthwise seams, so that the roof's weather-tight integrity is correspondingly enhanced.

The term "panel roofing" as used herein, encompasses "roof decking" which also is formed by a panel producing machine from metal sheet stock and is similar in appearance to panel roofing. Roof decking, individual panels of which are installed side-by-side like panel roofing, essentially differs from panel roofing in its use as an underlayment upon which additional roofing material is applied.

The sheet metal from which the panels of panel roofing may be formed is typically aluminum, steel or copper and has a nominal width of 24 inches, with larger widths being available. Each formed roofing panel has a smaller width than this due to the bending of the edges and possible introduction of ribs. Thus, for example, a 24 inch wide sheet of material may be formed into an 18 inch wide panel. A variety of panel producing machines are available from different manufacturers. Each requires having the sheet stock supplied thereto from a roll of sheet material. The machines, which may be driven by a gasoline engine, electric motor, hydraulics, or a combination thereof, form and extrude the roofing panels at rates on the order of 50 feet per minute. An exemplary panel producing machine is the model KR-18 machine manufactured by Knudson Manufacturing Company of Broomfield, Colo.

During installation of panel roofing, the panel producing machine is, typically, either positioned at the ground level, mounted on the edge of the roof, or suspended adjacent the roof edge by a crane. In the case where the machine is located at ground level, the panels produced must be hoisted to roof level for installation. Such a mode of operation obviously suffers the inconvenience of the additional hoisting operation and subsequent handling of each panel to correctly position it on the roof. The need for the hoisting operation is obviated by locating the panel producing machine at the roof edge level. In the case where the machine is mounted on the roof's edge, the individual panels as extruded from the machine must be carried from the machine to the desired position on the roof. If the roof is large, it may be necessary to carry the individual panels substantial distances. Further, the individual panels may be quite long since each will most likely have a length spanning the width of the entire roof area being covered. As a result, it may be quite difficult to carry the panels any significantly distance. Of course, the machine may be periodically relocated along the roof edge to the proximity of where panels are currently required. However, the machines are typically quite heavy. For example, the Knudson model KR-18 machine weighs approximately 3,200 pounds. It would therefore be necessary to periodically employ a crane to relocate the machine. This implicitly requires, disadvantageously, having the crane and its operator available throughout the roofing operation. This last disadvantage is also suffered by the mode of operation in which the machine is suspended from a crane, at the roof's edge, throughout the entire roofing operation.

One attempted solution to these disadvantages is provided in a system manufactured by Old American Roofing & Building System Company of Houston, Texas. The Old American system comprises a panel producing machine mounted on a platform which is in turn mounted on a hydraulic scissors lift. The platform and lift are in turn mounted on a trailer. In operation, the panel machine and platform are elevated to the roof level where the machine produces the individual roof panels. Periodically a truck can be used to relocate the machine closer to the location where the panels are required. The Old American system suffers the disadvantage of requiring that the trailer periodically be moved to minimize the above described problems associated with carrying the panels on the roof.

SUMMARY OF THE INVENTION

An object of the invention is to provide a panel roofing producing apparatus which can be easily transported to a work site and can effectively and efficiently produce panels at locations closely proximate the area where the panels will be fixed to a roof.

Another object is to provide a panel producing roofing apparatus which can be selectively moved along a roof's edge so that produced panels are correctly aligned with the roof as they are produced by the apparatus.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and described herein, the apparatus of the invention for producing panel roofing comprises an elongated platform; means slidably positioned on the platform for producing elongated sections of panel roofing from sheet metal material fed into an input end of the panel producing means, the panel sections being extruded from an output end of the panel producing means, the producing means being slidable along a length dimension of said platform and being oriented to extrude each elongated panel section along a dimension substantially perpendicular to the platform length dimension; means for elevating the platform to a selected elevation adjacent the edge of the roof with the platform length dimension parallel to the roof edge so that panel sections project onto the roof as they are extruded from the producing means; and means for selectively sliding the producing means along the length of the platform to a plurality of separate positions where a section of roofing panel is extruded onto the roof. With the inventive apparatus so configured, each panel produced by the panel producing means is extruded onto the roof proximate its intended installed location, the producing means being slidable along the platform following extrusion of each successive panel roofing section to a next intended panel installation location.

In accordance with a preferred embodiment of the invention, the inventive apparatus further includes means for adjusting an elevational pitch of the panel producing means relative to the platform to approximate a pitch of the roof on which the panel roofing is to be installed and means for selectively locking the panel producing means in a desired position relative to the platform while a section of roofing panel is extruded onto the roof.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings. Whenever possible, the same reference numbers will be used throughout the drawings to refer to the same or like parts.

Figure 1:
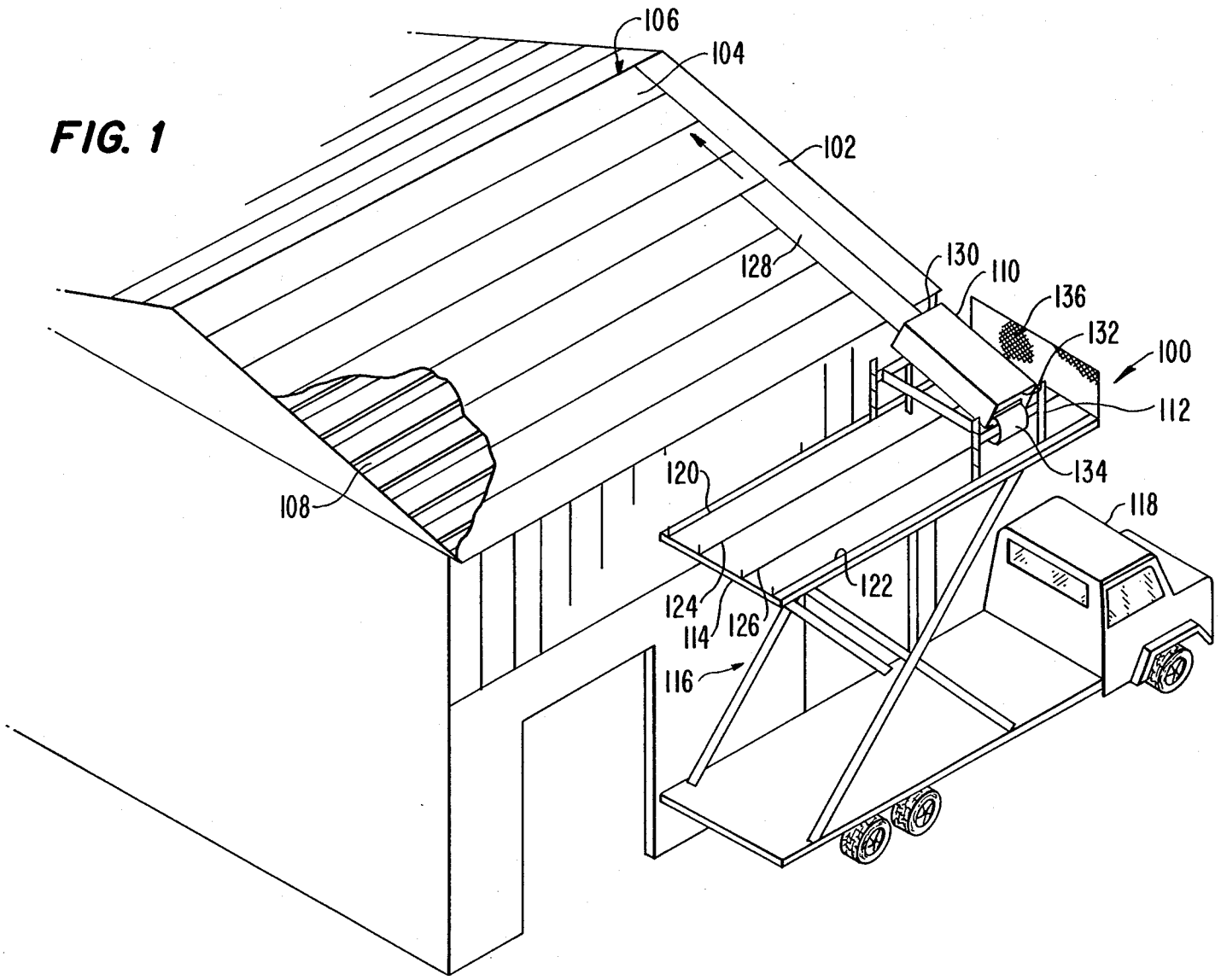
FIG. 1 is a perspective view illustrating apparatus for producing panel roofing in accordance with a preferred embodiment of the present invention.

The preferred embodiment of the apparatus for producing panel roofing material is shown in FIG. 1 and is designated generally by the reference numeral 100. The apparatus is being employed to extrude formed roofing panels 102 onto a roof surface 104 of a roof 106. Roof 106 is illustrated as being in a state of partial construction in which surface 104 represents an underlying weather sealing material such as tar paper. A break is provided in surface 104 to illustrate the underlying beam structure 108 of the roof, it being understood that no such break actually exists.

Apparatus 100 comprises means for producing elongated sections of panel roofing. As embodied herein, the panel producing means comprises a panel producing machine 110, of the type described hereinabove and known in the art, mounted on a support stand 112. Stand 112 is in turn mounted on a platform 114 which is attached to means for elevating the platform, the elevating means as embodied herein being provided as a platform elevating mechanism 116. Elevating mechanism 116 may be provided as a "Tesco Hylift" hydraulically operated elevating mechanism as manufactured by Truck and Equipment Service Corp. of Fort Lauderdale, Fla. That mechanism is capable of lifting the platform mounted thereon to a working height of 22 feet. The Tesco elevating mechanism is mounted on the bed of a truck 118 to enable transport thereby. Platform 114 is fabricated of steel with a thickness of approximately $\frac{1}{4}$ inch. In the preferred embodiment of the present invention, platform 114 has a length of 24 feet and a width of 8 feet.

Apparatus 100 further includes means for guiding movement of stand 112 along a length dimension of the platform. As embodied herein, the movement guiding means comprises a pair of tracks 120,122, fastened to platform 114, on which stand 112 is mounted. The tracks are mounted parallel to the length dimension of the platform. As described more fully hereinbelow, the respective legs of the stand are fitted with wheels or casters that ride on the pair of tracks along the platform length dimension. As seen in FIG. 1, machine 110 is mounted to extrude each roofing panel along a dimension perpendicular to the platform length dimension. The movement guiding means further comprises a second pair of tracks 124,126 mounted parallel to and between the first track pair. These tracks are provided for mounting a sheet stock decoiler 240, shown in FIG. 2, which is positioned on the platform beneath machine 110. As described more fully below, the decoiler is also mounted on wheels or casters to enable movement along the track.

The ability to effect translational movement along the length of platform 114 provides one of the advantages of the present invention. As each successive roofing panel is extruded from panel machine 110, in a direction perpendicular to the platform length dimension, the decoiler and stand 112 with the machine mounted thereon are moved along the length dimension of the platform by a distance equal to the panel width. As a result, each successive panel is extruded proximate the location it is to be installed on the roof. Thus as seen in FIG. 1, a panel 128 is being extruded in a position adjacent the previously extruded panel 102 already in place on the roof. After production of panel 128 is complete and it is in place on the roof, stand 112, with machine 110 mounted thereon, and the decoiler 240 will be moved down the platform length by the one panel width distance and the next panel will be produced. As described hereinbelow, such movement along the platform is easily effected and is both less troublesome and more closely controllable than achieving such movement by driving truck 118.

A further feature of the present invention, which is described in greater detail below, is the mounting of the machine on stand 112 in a manner that enables pitching an output end 130 of the machine to approximate the pitch of the roof onto which panels are being extruded. Thus, in FIG. 1, output end 130 of machine 110 is pitched upward relative to an opposite input end 132 thereof to orient the machine to have a pitch approximating that of the roof. Platform 114 as elevated by elevating mechanism 116 is substantially parallel to the ground.

Sheet metal 134, fed from the decoiler 240 (not shown in FIG. 1), is shown being fed into input end 132 of the panel producing machine. Also shown in FIG. 1 is a personnel safety barrier 136 mounted at one end of platform 114, the barrier being provided to prevent a worker from falling off of the platform when elevated. Additional guard rails (not shown) may also be positioned around the remainder of the platform periphery for the same purpose.

Figures 2, 2A:
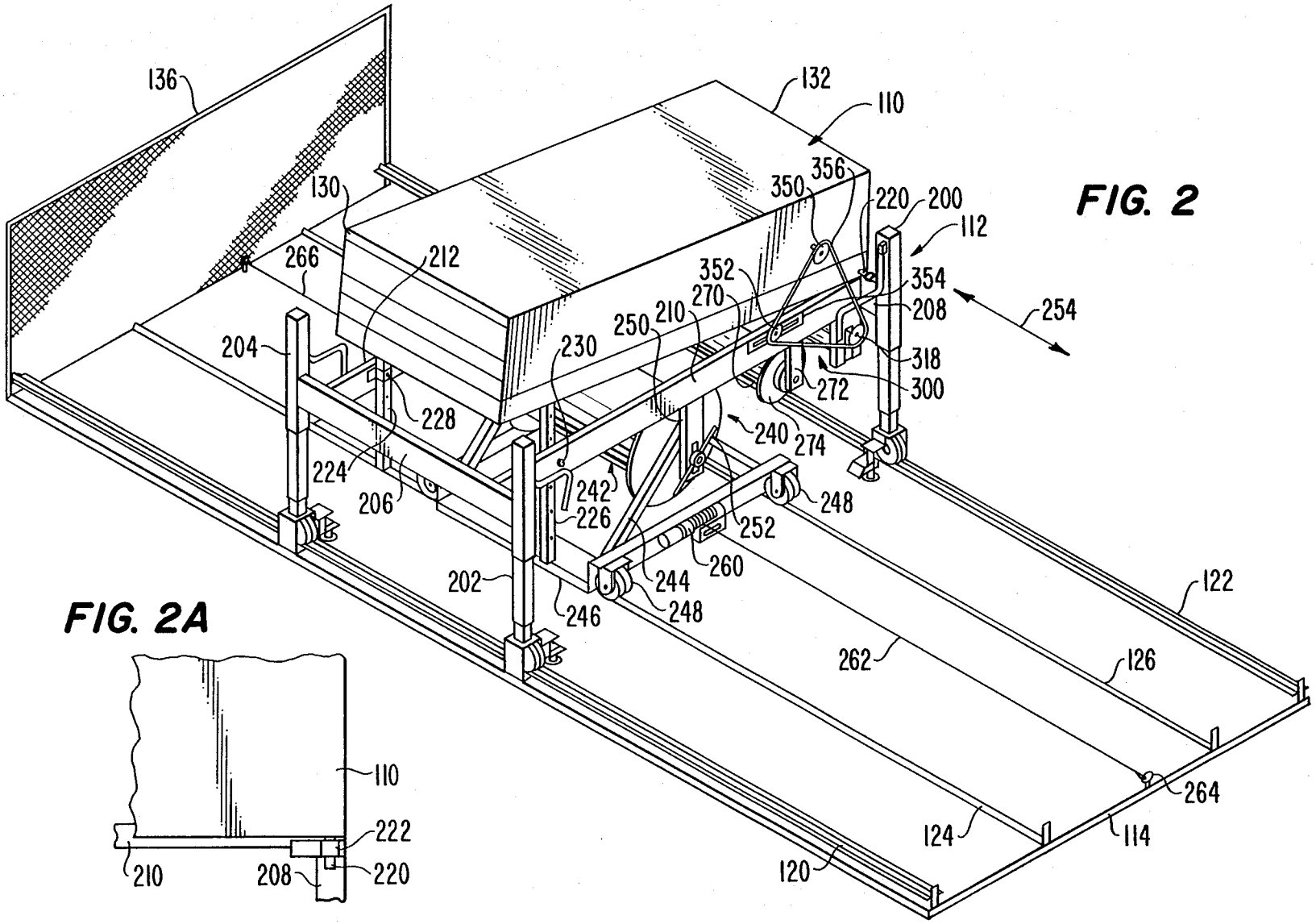
FIG. 2 is a perspective view illustrating in greater detail certain parts of the panel producing apparatus shown in FIG. 1.
FIG. 2A is a fragmentary plan view illustrating in greater detail a pin and sleeve assembly shown in FIG. 2.

FIG. 2 illustrates platform 114 and the apparatus mounted thereon in greater detail. Support stand 112 comprises four identical leg members of which three members 200, 202 and 204 are visible in the Figure. The support stand further comprises a front bracing member 206 and a rear bracing member 208 which respectively bridge between leg members. Stand 112 additionally includes two support members 210 and 212 which respectively bridge between the front and rear bracing members. Each bracing member 206,208 is preferably provided as a steel 8 inch C-channel member. Each support member is preferably provided as a steel 8 inch I-beam. In accordance with a preferred construction of stand 112, the respective ends of each bracing member are welded to upper portions of the leg members bridged thereby. Thus, for example, the ends of bracing member 206 are respectively welded to the upper portions of leg members 202 and 204. The detailed construction of the leg members is described in greater detail hereinbelow with respect to FIG. 4.

Panel producing machine 110 is supported on support members 210 and 212, such that those two members are spaced apart by a width effective to support the machine. As a result, when the machine output end is not pitched upward, it rests on the support members. As described above and also illustrated in FIG. 2, machine 110 is mounted on stand 112 to extrude each panel along a dimension perpendicular to the platform length dimension.

The panel producing apparatus further includes means for adjusting the elevational pitch of machine 110. As embodied herein, the pitch adjusting means includes a hinge mechanism which pivotally attaches the panel producing machine 110 to the stand 112. In the embodiment illustrated, two hinge pins respectively protude from the sides of machine 110 near its bottom at input end 132. One of the two hinge pins, a pin 220, is visible in FIGS. 2 and 2A. The two pins respectively fit into corresponding pin sleeves affixed to brace 208. One such pin sleeve 222 is shown in FIG. 2A which illustrates the pin and sleeve as viewed from above machine 110. A pair of panel machine support legs 224 and 226 are hingedly connected to the underside of machine 110 near the output end thereof. Each leg 224,226 passes through a leg sleeve affixed, e.g. by welding, to a side surface of the support member proximate thereto. Thus, as illustrated in FIG. 2, machine support leg 224 passes through a leg sleeve 228 affixed to the inside surface of support member 212. With the machine so supported, the output end of machine 110 can be elevated relative to the input end, i.e., the machine can be pitched, with legs 224 and 226 freely passing through their respective leg sleeves and the machine pivoting about the hinged engagement of hinge pins with their corresponding sleeves at the machine input end. Each machine support leg 224,226 includes a plurality of holes passing therethrough, so that each machine support leg can be fixed, when a desired pitch of machine 110 is achieved, by passing a pin through the hole in the leg as well as through a hole in the proximate support member and leg sleeve. As seen in FIG. 2, a pin 230 is illustrated as passing through a hole provided in support member 210 and leg 226. As discussed hereinabove, the machine is preferably pitched to an angle approximating the pitch of the roof onto which roofing panels are being extruded. Since the holes in each leg 224,226 are discretely spaced from one another, the pitch to which the machine can be set is an approximation of the roof pitch. Lifting means such as a boom crane may be provided on truck 118 to facilitate adjusting the elevational pitch of machine 110.

Still referring to FIG. 2, a decoiler 240 is illustrated as mounted on tracks 124 and 126 beneath support stand 112. The decoiler includes a cylindrical mandrel 242 for carrying the coiled sheet stock. The spacing between the end flanges of the mandrel is selected to accommodate the width of sheet material to be carried and decoiled by the decoiler. The ends of decoiler mandrel 242 are supported on a frame 244 constructed from angle steel members which are in turn affixed, e.g., by welding, to a steel dolly 246. The mandrel is supported for rotation about a cylinder axis thereof. Dolly 246 rides on wheels in the form of steel casters 248 each having a circumferential V-groove. Such casters are available from Payson, Inc. of Gurney, Illinois. Casters 248 ride on track 124 and 126 which are preferably provided as lengths of $1\frac{1}{4}''$ angle steel welded to the surface of platform 114.

It is preferable, during operation of machine 110; that the position of the decoiler be fixed relative to stand 112 in order to maintain an alignment between the sheet material being drawn from the decoiler and the machine. Thus, means are provided for fixing the position of the frame and dolly of the decoiler relative to stand 112. As embodied herein, the position fixing means comprises a bracket 250 affixed to support member 210 of support stand 112, the bracket including a slot-shaped opening. The position fixing means further comprises a threaded rod affixed to frame 244 and projecting through the slot-shaped opening in bracket 250. A wing nut 252 is tightened onto the threaded rod against the outer surface of bracket 250. By also providing a nut on the threaded rod that rests against an inside surface (i.e., the surface facing away from the viewer of FIG. 2.) of bracket 250, the position of decoiler 240 relative to support stand 112 can be both adjusted and fixed.

As indicated hereinabove, the leg members of support stand 112 include casters that ride on tracks 120 and 122. Since as described above, the position of the decoiler is preferably fixed relative to the support stand, the decoiler and support stand can be moved in unison along tracks 120, 122, 124 and 126, on their respective casters, along the platform length dimension. An arrow 254 indicates this length dimension in FIG. 2. The apparatus of the present invention includes means for driving this movement, such means preferably comprising two electric winches mounted on opposite sides of dolly 246 of decoiler 240. One winch 260 is visible in FIG. 2. The respective winches operate in opposite rotational directions to respectively pay out and reel in an associated steel cable, an end of each steel cable being anchored proximate an end of platform 114. Thus, a cable 262 is wound on winch 260 and affixed to an anchor device 264 on platform 114. While the second winch is not visible, a cable 266 associated therewith is visible. Obviously if winch 260 is operated to reel its cable in while the other winch is operated to pay cable out, the decoiler and support stand will be driven to move toward anchor device 264.

The intended power supply for the winches is a battery (not shown) that is preferably mounted on a bracket (not shown) affixed to either support member 210 and 212. The battery is also available for starting a gasoline engine (not shown) for driving machine 110, such a gasoline engine being mountable either directly on machine 110 or on a bracket (not shown) affixed to support stand 112. The power from the battery is preferably conducted by cables which are detachable from each winch. Such detachability is necessary to enable decoiler 240 to be periodically rolled out from under stand 112 in order to replenish the supply of sheet stock material carried thereby.

The panel producing apparatus of the present invention further includes means for guiding to machine 110 the sheet material held on the decoiler. As embodied herein and as shown in FIG. 2, the sheet guiding means comprising a cylindrical guide roller 270 supported between brackets affixed to support members 210 and 212 of stand 112, one such bracket 272 being visible in FIG. 2. The guide roller is mounted for rotation about a cylinder axis thereof. During operation of machine 110, the coiled sheet stock material held on the decoiler is preferably drawn from the lower portion of the decoiler (i.e. nearest platform 114) and passed over the top of guide roller 270, the guide roller rotating freely about its cylinder axis due to contact with the sheet material passing thereover. The guide roller includes two end flanges, one such end flange 274 being visible in FIG. 2. The guide roller end flanges are preferably spaced apart to slightly exceed the sheet stock material width and thereby provide lateral guidance for the material as it is fed into the panel producing machine. It is further preferred herein that each guide roller end flange be mounted on the guide roller by set screws which can be loosened to enable adjustment of the space between the flanges. In this manner, sheet stock materials of different widths can be accommodated.

Figure 3:
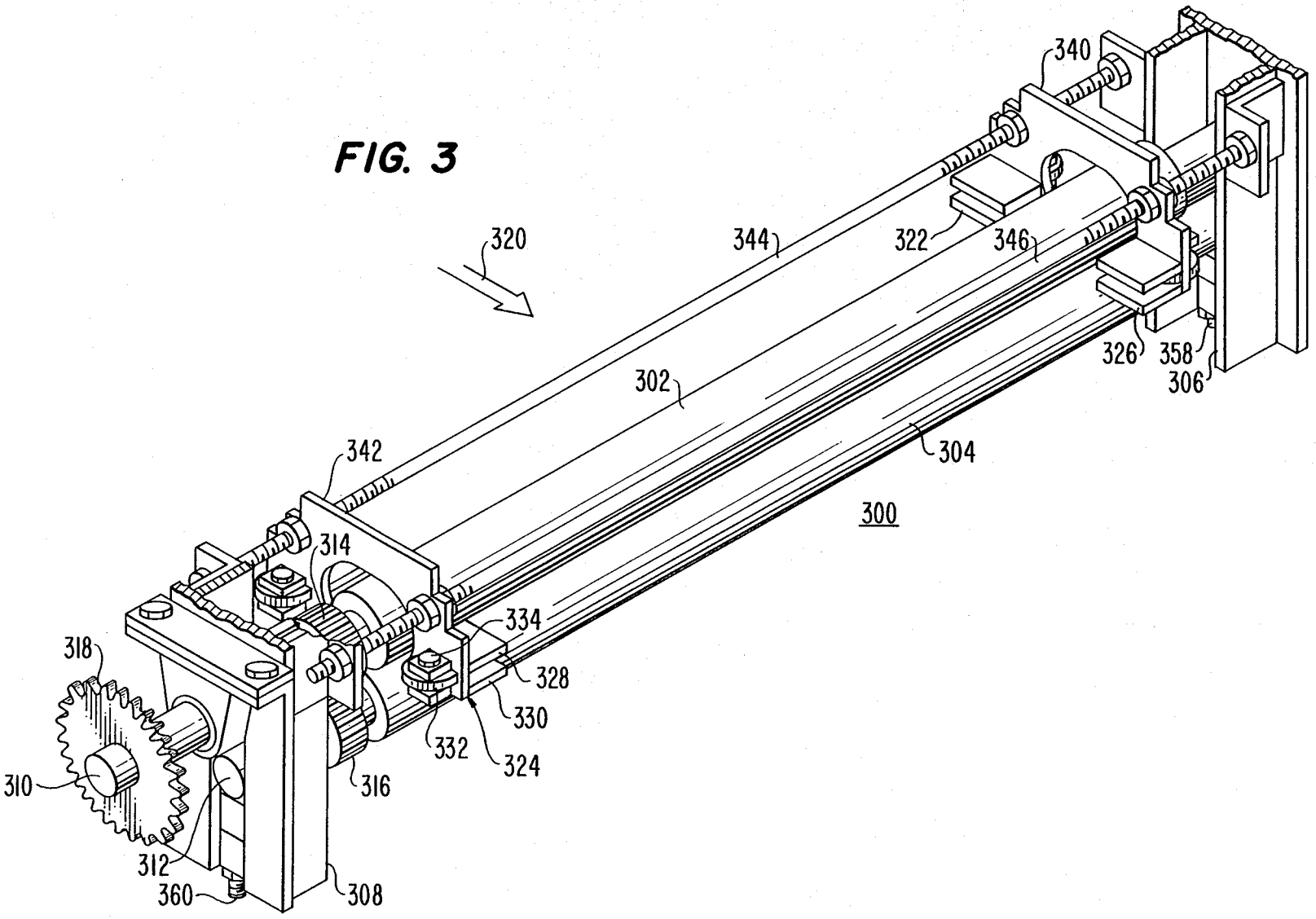
FIG. 3 is a perspective view illustrating a draw roller mechanism of the panel producing apparatus.

The above noted sheet guiding means of the panel producing apparatus additionally comprises draw roller means for drawing the sheet material from the decoiler at a predetermined rate. As embodied herein, the draw roller means comprises a draw roller assembly generally indicated by the reference numeral 300 in FIG. 2 and illustrated in greater detail in FIG. 3. With reference to FIG. 3, roller assembly 300 comprises a pair of cylindrical draw rollers 302 and 304. The ends of rollers 302 and 304 are mounted at one end ina bearing stand 306 (fixed to support member 212) which supports two bearings (not shown), each supporting a free end of one roller. The opposite ends of the rollers are supported in a bearing stand 308 (fixed to support member 210) by bearings not shown. The rollers are thus rotatable about their respective cylinder axes. Extended shaft portions 310 and 312 of rollers 302 and 304, respectively, are identified in FIG. 3. As is partially visible in FIG. 3, meshing gears 314 and 316 are mounted on the shafts of rollers 302 and 304, respectively, proximate bearing stand 308. The two meshing gears mesh together so that by driving rotation of roller 302, in a manner described below, rotational motion in the opposite rotational sense is imparted to roller 304 via the meshing gears.

As seen in FIG. 3, extended shaft portion 310 of roller 302 extends further from bearing stand 308 than shaft portion 312 and has a sprocket 318 affixed thereto. Sprocket 318 is also visible in FIG. 2 and is so identified.

Draw roller assembly 300 is mounted to the underside of support members 210 and 212 such that roller 302 is closet to the underside of machine 110 and the respective cylinder axes of rollers 302 and 304 are parallel to the cylinder axes of decoiler 240 and guide roller 270. With assembly 300 so mounted, the sheet stock material drawn from the decoiler and guided over guide roller 270 is drawn between rollers 302 and 304 in a direction 320. The sheet material is guided between the rollers by a pair of inboard guides, of which only a guide 322 is visible in FIG. 3, and a pair of outboard guides 324 and 326. The four guides are substantially identical, so that the detailed construction of each guide can be described with respect to guide 324. That guide includes two guide flanges 328 and 330 between which the sheet material is passed. The guide further includes a wheel-like roller 332, a circumferential portion of which protrudes into the space between flanges 328 and 330. Roller 332 is mounted to freely rotate about a pin 334. As a result, the edge of the sheet material drawn between the guide flanges contacts the roller circumference and the roller rotates to promote a low friction guiding contact withe the sheet edge. As also seen in FIG. 3, guides 322 and 326 are mounted on a common bracket 340, the remaining two guides being mounted on a bracket 342. Brackets 340 and 342 are in turn mounted on a pair of threaded rods 344 and 346 and constrained thereon by threaded nuts positioned on either side of each bracket. By adjusting the respective positions of the nuts on rods 344 and 346, the respective positions of the guides can be adjusted to accommodate the width of the particular sheet material being drawn through the draw roller assembly.

As a further feature of the present invention, the panel producing apparatus further includes means for synchronizing operation of the draw roller assembly with machine 110. As embodied herei, the synchronizing means comprises a sprocket 350 (FIG. 2) affixed to an extended shaft of panel producing machine 110 which rotates during machine operation. With respect to the above noted Knudson model KR-18 machine, sprocket 350 is affixed to an extended shaft of a second station lower roller of the machine. Further, with reference to FIG. 2, an idler sprocket 352 is mounted on a slotted bracket 354 on support member 210, such that sprocket 352 can be locked at any desired position along the slot in bracket 354. A chain 356 is provided to link sprockets 318, 350 and 352 together, the tension of the chain being adjusted by appropriately locating idler sprocket 352 along the bracket 354 slot. During operation of machine 110, the rotation of sprocket 350 drives rotation of sprocket 318 via chain 356. As is apparent from FIG. 3, the driving of sprocket 318 causes rotation of roller 302, which in turn causes, via the engagement of meshing gears 314 and 316, the rotations of roller 304. The above noted resulting opposite rotations of rollers 302 and 304 cause sheet material passing between the rollers to be forcibly drawn therethrough. This, of course, assumes that the space between rollers 302 and 304 through which the sheet material passes is adjusted to exert a suitable gripping force on the sheet material. Such adjustment is preferably effected by providing an adjusting mechanism within each bearing stand 306 and 308 that is operable to adjust the position of the bearings supporting roller 304 relative to the roller 302 bearings. In a preferred construction, with respect to each bearing stand, a threaded bolt is passed through a matingly threaded nut affixed to the bearing stand, with one end of the bolt in contact with the underside of the roller 304 bearing. Clockwise rotation of the bolt results in urging the roller 304 bearing upward toward roller 302. Free ends of bolts 358 and 360, respectively protruding from bearing stands 306 and 308, comprising a portion of this adjusting mechanism, are visible in FIG. 3.

Referring to both FIGS. 2 and 3, the sprockets 318, 350 and 352 are selected so that with machine 110 operating, the draw rollers are driven to draw material from the decoiler at a rate substantially equal to a feed rate at which the panel producing machine consumes the sheet material.

Figure 4:
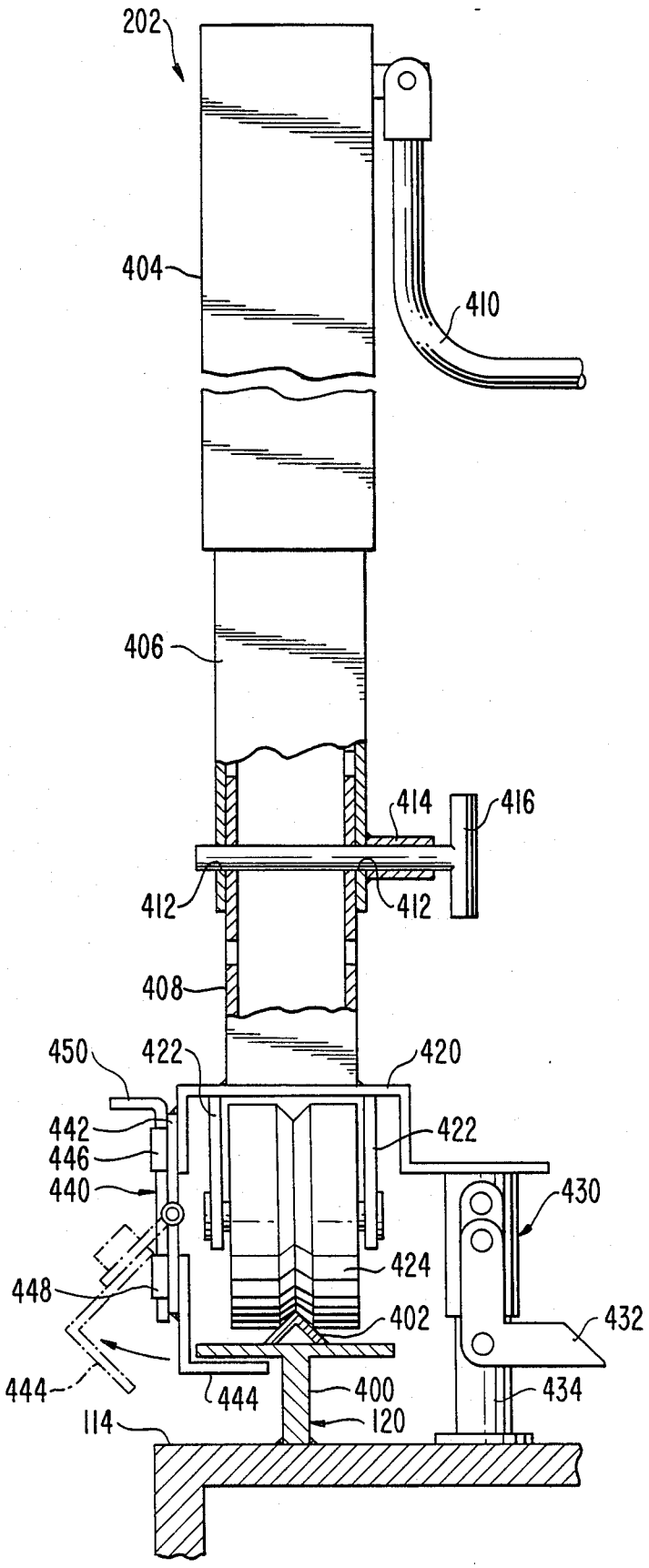
FIG. 4 is a side and partial cross-sectional view illustrating in greater detail a leg member of a supprt stand illustrated in FIGS. 1 and 2.

FIG. 4 illustrates leg member 202 riding on track 120 as viewed, in FIG. 2, from the end of platform 114 at which anchor 264 is located. The construction of track 120 is seen to consist of a steel T-member 400, welded to the surface of platform 114 and a steel angle 402 welded along a top surface of T-member 400. The T-member preferably measures 4 inches across the top of the "T" and 2 inches in height. The steel angle is preferably 1¼ inches wide on each side. Leg member 202 comprises an upper leg portion 404, an intermediate leg portion 406 and a lower leg portion 408. As illustrated in FIG. 4, the three leg portions 404, 406 and 408 are hollow and sized to fit within one another. The leg portions are preferably constructed of steel stock having a square cross section. Leg portions 404 and 406 are engaged by a telescoping mechanism such that by operating a hand crank 410, intermediate portion 406 can be telescopically extended from or retracted into upper portion 404. Leg portion 406 includes a hole 412 passing through it proximate a lower end thereof. A hollow sleeve 414 is affixed, e.g. by welding, to one side of leg portion 406 with a bore of the sleeve aligned with hole 412. Lower leg portion 408 includes a series of holes each of which is alignable with hole 412. Upon aligning, with hole 412, the leg portion 408 hole that corresponds to a desired extension of lower leg portion 408 from intermediate leg portion 406, a pin 416 is passed through sleeve 414 and the holes in both leg portions. Thus, the length of each leg is adjustable by hand crank 410 and by the selection of a hole in leg portion 408. The adjustability of the leg members enables adjustable control of the position of machine 110 relative to the roof edge, in addition to the adjustability afforded by elevating mechanism 116.

A support flange 420 is affixed, e.g. by welding, to lower leg portion 408, flange 420 carrying a caster bracket 422 for mounting a caster 424. As can be seen in FIG. 4, caster 424 has a circumferential V-groove for riding on steel angle 402. The caster can be provided by the above-noted Payson, Inc.

As an additional feature of the presnt invention, means are provided for locking stand 112 against movement along platform 114. As embodied herein, the locking means comprises a leg locking mechanims 430 affixed to flange 420. Depression of a foot pedal 432 of the locking mechanism forces a lower portion 434 of mechanism 430 against the surface of platform 114. Thus, by actuating the locking mechanism in this manner, stand 112 can be locked against rolling motion along tracks 120 and 122. It is noted that since decoiler 240 is affixed to stand 112 in the manner described hereinabove, locking stand 112 against movement is effective to lock the decoiler against movement along tracks 124 and 126.

Leg member 202 also includes a keeper apparatus 440. The keeper apparatus comprises an upper member 442 affixed to flange 420 and a lower member 444 hingedly fastened to upper member 442. Lower member 444 is shown in both a locked position and an unlocked position, the latter position being delineated by a broken line. Upper and lower members 442 and 444 have sleeves 446 and 448 respectively attached thereto. Sleeves 446,448 are aligned to receive a bolt 450 passed therethrough when lower member 444 is in the locked position. As seen in FIG. 4, with the keeper lower member in the locked position, on all four legs of stand 112, the stand is inhibited from becoming derailed from tracks 120 and 122.

In operation, the apparatus of the present invention is driven to the job site where roofing panels are to be installed. If a roll of sheet metal is not already in place on the machine, the roll decoiler 240 is disconnected from the support stand 112 and rolled out from under the panel producing machine, so that a roll of sheet metal can be placed on the decoiler 240. The decoiler and the stand 112 are then connected and the sheet metal is fed over the guide roller, between the draw rollers and into the panel producing machine 110. The truck is then driven to a position below and aligned with the roof edge.

Panel producing apparatus 100 of the present invention is then elevated by elevating mechanism 116 to an elevation proximate the edge of the roof on which panel roofing is to be installed. The platform is positioned with the length dimension thereof parallel to the roof edge. Panel producing machine 110 is pitched to approximate the roof pitch. Stand 112 is positioned along the length of platform 114 to align machine 110 with a position on the roof where the first roofing panel is to be installed. It is preferred that platform 114 be positioned by truck 118 such that stand 112 is located at one end of platform 114 to install the first panel. In this manner, stand 112 can simply be rolled along the platform length to install each successive roofing panel without need for moving the truck. With stand 112 so positioned and decoiler 240, mounted thereunder, holding the sheet material, machine 110 is operated to produce roofing panels. Thus, the machine draws the sheet material into its input end and extrudes each roofing panel from its output end. Machine operation is suspended upon each panel being extruded to a desired length so that the individual panel may be severed from the machine. Machine operation drives the draw rollers in the manner described above to draw sheet stock material from the decoiler, the drawn material being guided to the draw rollers by the guide roller and guided through the draw rollers by the inboard and outboard guides. After each roofing panel is so produced, support stand 112 and the decoiler are moved along the platform length dimension to the next intended panel installation location, so that the next panel can be extruded onto the roof proximate its intended installed location.

While the TESCO Hylift mechanism described hereinabove is preferred, other elevating mechanisms are known in the art and the invention may be practiced with equal effectiveness therewith. Other elevating mechanisms may be utilized to achieve elevation to heights in excess of the 22 foot capability of the TESCO Hylift mechanism where the roof height so requires.

As described above, tracks 124 and 126 are provided as lengths of angle steel welded to platform 114. However, tracks 124 and 126 could with equal effectiveness be configured the same as tracks 120 and 122, i.e. angle steel welded to T-bar steel which is in turn welded to the platform. Also, while a particular arrangement of angle steel and circumferentially V-grooved casters has been described and illustrated herein for guiding movement of stand 112 and decoiler 240 along platform 114, other arrangements for guiding their movement will now occur to those skilled in the art. Further, while members of stand 112 and decoiler 240 are preferably assembled by welding, the invention can as well be practiced by employing bolted construction of these elements.

Thus, it is intended that the present invention cover the modifications and the variations of this invention provided they come within the scope of the appended claims and their equivalents.

What is claimed is:

1. Apparatus for producing panel roofing to be fixed to a roof, the apparatus comprising:

an elongated platform;

means slidably positioned on said platform for producing elongated sections of panel roofing from sheet metal material fed into an input end of said panel producing means, the panel sections being extruded from an output end of said panel producing means, said producing means being slidable along a length dimension of said platform and being oriented to extrude each elongated panel section along a dimension substantially perpendicular to said platform length dimension;

means for elevating said platform to a selected elevation adjacent the edge of the roof with the platform length dimension parallel to the roof edge so that panel sections project onto the roof as they are extruded from said producing means; and means for selectively sliding the producing means along the length of the platform to a plurality of separate positions where a section of roofing panel is extruded onto the roof;

whereby each panel produced by said panel producing means is extruded onto the roof proximate its intended installed location, said producing means being slidable along said platform following extrusion of each successive panel roofing section to a next intended panel installation location.

2. The apparatus of claim 1 further including means for adjusting an elevational pitch of said panel producing means relative to said platform to approximate a pitch of the roof on which the panel roofing is to be installed.

3. The apparatus of claims 1 or 2 further including means for selectively locking said producing means in a desired position relative to said platform while a section of roofing panel is extruded onto the roof.

4. The apparatus of claims 1 or 2 further comprising a decoiler means to hold coiled sheet material to be fed into said panel producing means.

5. The apparatus of claim 4 wherein said decoiler means is slidably positioned on said platform and is slideable along the length dimension of said platform.

6. The apparatus of claim 5 further comprising means for selectively fixing said decoiler means to said panel producing means so that the decoiler means and panel producing means can be slid as unitary structure along said platform.

7. The apparatus of claim 6 further comprising draw roller means for drawing the sheet material from said decoiler means, guiding the sheet material to said panel producing means and synchronizing the operation of the draw roller means with said panel producing means so that said draw roller means draws the sheet material from said decoiler at a rate equal to a feed rate of said panel producing means.

8. The apparatus of claim 7 wherein said draw roller means includes linkage means which interconnects a motor of said panel producing means with said draw roller means.

9. The apparatus of claim 5 further comprising draw roller means for drawing the sheet material from said decoiler means, guiding the sheet material to said panel procuding means and synchronizing the operation of the draw roller means with said panel producing means so that said draw roller means draws the sheet material from said decoiler at a rate equal to a feed rate of said panel producing means.

10. Apparatus for producing panel roofing, comprising:

a platform;

means for elevating said platform to a predetermined elevation;

means for producing elongated sections of panel roofing from sheet material fed into an input end of said panel producing means, the panel sections being extruded from an output end of said panel producing means;

first support means to support said panel producing means so that said panel producing means is oriented on said first support means to extrude each elongated panel section along a dimension perpendicular to a length dimension of said platform;

decoiler means to hold coiled sheet material to be fed into said panel producing means;

second support means to support said decoiler means;

said first and second support means being movable along said platform length dimension and being mutually alignable to enable the coiled sheet material held on said decoiler means to be fed into said panel producing means; and means for guiding the movement of said first and second support means along said platform length dimension to a plurality of separate positions where a section of roofing panel is extruded onto the roof;

whereby said platform can be raised to an elevation proximate an edge of a roof on which panel roofing is to be installed with the platform length dimension parallel to the roof edge, so that each panel produced by said panel producing means is extruded onto the roof proximate its intended installed location, said first and second support means being movable along said platform following extrusion of each successive panel roofing section to a next intended panel installation location.

11. The apparatus of claim 10 further including means for adjusting an elevational pitch of said panel producing means relative to said first support means to approximate a pitch of the roof on which the panel roofing is to be installed.

12. The apparatus of claim 10 wherein said first support means is movable relative to said second support means and further including means for selectively fixing the position of said second support means relative to said first support means.

13. The apparatus of claim 10 further including means mounted on said first support means for guiding to said panel producing means the coiled sheet material held on said decoiler means.

14. The apparatus of claim 10 wherein said movement guiding means includes:

a first set of tracks mounted on said platform and parallel to said length dimension, said first set of tracks engaging said first support means and guiding movements of said first support means; and a second set of tracks mounted on said platform parallel to said first set of tracks, said second set of tracks engaging said support means and guiding movement of said second support means.

15. The apparatus of claim 14 further including means for locking said first support stand against movement along said platform length dimension.

16. The apparatus of claim 13 wherein said sheet material guiding means includes a guide roller mounted on said first support means; and draw roller means, mounted on said first support means, for drawing the sheet material from said decoiler means at a predetermined rate, said guide roller means being interposed between said decoiler means and said draw roller means to guide the sheet material drawn from said decoiler means by said draw roller means, the sheet material being fed into said panel producing means after passing through said draw roller means.

17. The apparatus of claim 16 wherein said sheet material guiding means further includes means for synchronizing the operation of said draw roller means with said panel producing means so that said draw roller means draws the sheet material from said decoiler means at a rate equal to a feed rate of said panel producing means.

18. The apparatus of claim 16 wherein said sheet material guiding means further includes:

a first pair of adjustable lateral guides located on an inboard side of said draw roller means; and a second pair of adjustable lateral guides located on an outboard side of said roller means, said first and second lateral guide pairs each constraining the sheet material drawn through said draw roller means to maintain a predetermined alignment therewith.

19. The apparatus of claim 10 further comprising means for selectively moving said first support means and said second support means along the length dimension of the platform to a plurality of separate positions where a section of roofing is extruded onto the roof.

20. The apparatus of claim 19 wherein said selective moving means includes a servomotor fixed to one of said platform or said first support means.

21. A system for producing panel roofing, comprising:

a load raising vehicle including a platform which can be controllably raised to a predetermined elevation;

a panel producing machine for producing elongated sections of panel roofing from sheet material fed into an input end of said machine, each panel section being extruded from an output end of said machine;

a first support stand on which said machine is mounted so that said machine is oriented on said first support stand to extrude the roofing elongated sections along a dimension perpendicular to a length dimension of said platform;

a decoiler for holding coiled sheet material to be fed into said machine;

a second support stand for supporting said decoiler;

said first and second support stands being movable along said platform length dimension and being alignable with one another to enable coiled sheet material held on said decoiler to be fed into said machine; and means for guiding the movement of said first and second support stands along said platform length dimension to a plurality of separate positions where a section of roofing panel is extruded onto the roof;

so that upon raising said platform to an elevation proximate an edge of a roof on which panel roofing is to be installed with the platform length dimension parallel to the roof edge, each panel produced by said machine is extruded onto the roof in a position proximate its intended installed location, said first and second support stands being movable along said platform following extrusion of each successive panel roofing section to a next intended panel installation location.

22. The system of claim 21 further including means for adjusting an elevational pitch of said machine relative to said first support stand to approximate a pitch of the roof on which the panel roofing is to be installed.

23. The system of claim 21 wherein said first support means is movable relative to said second support means and further including means for selectively fixing the position of said second stand relative to said first support stand.

24. The system of claim 21 further including means mounted on said first support stand for guiding to said machine the coiled sheet material held on said decoiler.

25. The system of claim 21, said movement guiding means including:

a first set of tracks mounted on said platform and parallel to said length dimension, said first set of tracks engaging said first support stand and guiding movement of said first support stand; and a second set of tracks mounted on said platform parallel to said first set of tracks, said second set of tracks engaging said second support stand and guiding movement of said second support stand.

26. The system of claim 25 further including means for locking said first support stand against movement along said platform length dimension.

27. The system of claim 21 wherein said sheet material guiding means includes a guide roller mounted on said first support stand and draw roller means, mounted on said first support stand, for drawing the sheet material from said decoiler at a predetermined rate, said guide roller means being interposed between said decoiler and said draw roller means to guide the sheet material drawn from said decoiler by said draw roller means, the sheet material being fed into said machine after passing through said draw roller means.

28. The system of claim 27 wherein said sheet material guiding means further includes means for synchronizing the operation of said draw roller means with said machine so that said draw roller means draws the sheet material at a rate equal to a feed rate of said machine.

29. The system of claim 27 wherein said sheet material guiding means further includes:

a first pair of adjustable lateral guides located on an inboard side of said draw roller means; and a second pair of adjustable lateral guides located on an outboard side of said draw roller means, said first and second lateral guide pairs each constraining the sheet material drawn through said draw roller means to maintain a predetermined alignment therewith.

* * * * *